US011264154B2

(12) United States Patent
Yoneyama et al.

(10) Patent No.: US 11,264,154 B2
(45) Date of Patent: Mar. 1, 2022

(54) RARE EARTH PERMANENT MAGNET AND RARE EARTH PERMANENT MAGNET MANUFACTURING METHOD

(71) Applicant: IHI Corporation, Tokyo (JP)

(72) Inventors: Natsuki Yoneyama, Tokyo (JP); Haruki Eguchi, Tokyo (JP); Hidekazu Tomono, Tokyo (JP); Isao Nakanowatari, Tokyo (JP); Keisuke Nagao, Tokyo (JP)

(73) Assignee: IHI Corporation, Tokyo (JP)

( * ) Notice: Subject to any disclaimer, the term of this patent is extended or adjusted under 35 U.S.C. 154(b) by 23 days.

(21) Appl. No.: 16/345,270

(22) PCT Filed: Oct. 27, 2017

(86) PCT No.: PCT/JP2017/039015
§ 371 (c)(1),
(2) Date: Apr. 26, 2019

(87) PCT Pub. No.: WO2018/079755
PCT Pub. Date: May 3, 2018

(65) Prior Publication Data

US 2019/0295753 A1 Sep. 26, 2019

(30) Foreign Application Priority Data

Oct. 28, 2016 (JP) ..... JP2016-212359

(51) Int. Cl.
*H01F 1/057* (2006.01)
*H01F 41/02* (2006.01)
(Continued)

(52) U.S. Cl.
CPC ..... *H01F 1/0577* (2013.01); *B22F 1/00* (2013.01); *B22F 3/00* (2013.01); *B22F 3/10* (2013.01);
(Continued)

(58) Field of Classification Search
None
See application file for complete search history.

(56) References Cited

U.S. PATENT DOCUMENTS 8,540,929 B2 9/2013 Irie et al.
2004/0189426 A1 9/2004 Hidaka et al.
(Continued)

FOREIGN PATENT DOCUMENTS

CN 102122567 A 7/2011
CN 107533893 A 1/2018
(Continued)

OTHER PUBLICATIONS

Chinese Office Action dated Mar. 30, 2020 for the Chinese Patent Application No. 201780066952.5.
(Continued)

*Primary Examiner* — Xiaowei Su
(74) *Attorney, Agent, or Firm* — Volpe Koenig

(57) ABSTRACT

A rare earth permanent magnet includes a main phase containing: a rare earth element R of one or more types including Nd; an element L of one or more types selected from a group consisting of Co, Be, Li, Al, and Si; B; and Fe, wherein crystals which form the main phase belong to $P4_2/mnm$; some of B atoms occupying a 4f site of the crystals are substituted with atoms of the element L; each distribution of Nd atoms and the atoms of the element L appears along a C-axis direction of the crystals in a plurality of cycles; and the rare earth permanent magnet includes an area where a cycle of the atoms of the element L matches a cycle of the Nd atoms.

2 Claims, 8 Drawing Sheets

(51) Int. Cl.

| | |
|---|---|
| ***B22F 3/10*** | (2006.01) |
| ***B22F 3/24*** | (2006.01) |
| ***C22C 38/00*** | (2006.01) |
| ***B22F 1/00*** | (2022.01) |
| ***C21D 6/00*** | (2006.01) |
| ***B22F 3/00*** | (2021.01) |

(52) U.S. Cl.
CPC ..... *B22F 3/24* (2013.01); *C21D 6/00* (2013.01); *C22C 38/005* (2013.01); *H01F 1/057* (2013.01); *H01F 41/02* (2013.01); *H01F 41/0266* (2013.01); *B22F 2003/248* (2013.01); *B22F 2301/355* (2013.01); *C22C 38/00* (2013.01); *C22C 2202/02* (2013.01)

(56) References Cited

U.S. PATENT DOCUMENTS

2009/0127494 A1* 5/2009 Kanekiyo ..... B22F 1/0044 252/62.55
2010/0233016 A1 9/2010 Tsubokura
2011/0121498 A1* 5/2011 Irie ..... C22C 38/005 264/612
2015/0243434 A1* 8/2015 Sun ..... C22C 33/0278 419/29
2016/0189837 A1* 6/2016 Ishii ..... C22C 38/005 419/29
2018/0047488 A1 2/2018 Tomono et al.

FOREIGN PATENT DOCUMENTS

| | | | |
|---|---|---|---|
| EP | 3067900 | A1 | 9/2016 |
| JP | 06-168812 | A | 6/1994 |
| JP | 07-201619 | A | 8/1995 |
| JP | 10-022154 | A | 1/1998 |
| JP | 2005-197533 | A | 7/2005 |
| JP | 2005-320628 | A | 11/2005 |
| JP | 2013-070062 | A | 4/2013 |

OTHER PUBLICATIONS

International Search Report, PCT/JP2017/039015, 2 pgs.
Extended European Search Report dated Jun. 8, 2020 for the European Patent Application No. 17864421.7.
Korean Office Action issued on Jul. 3, 2020 for the Korean Patent Application No. 10-2019-7015115.

* cited by examiner

FIG. 2A
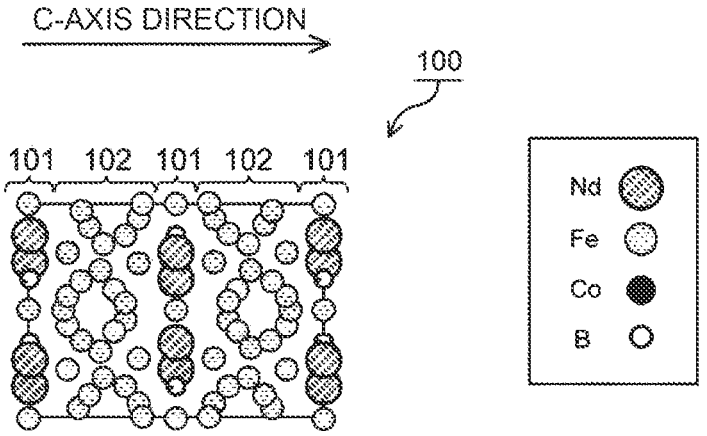
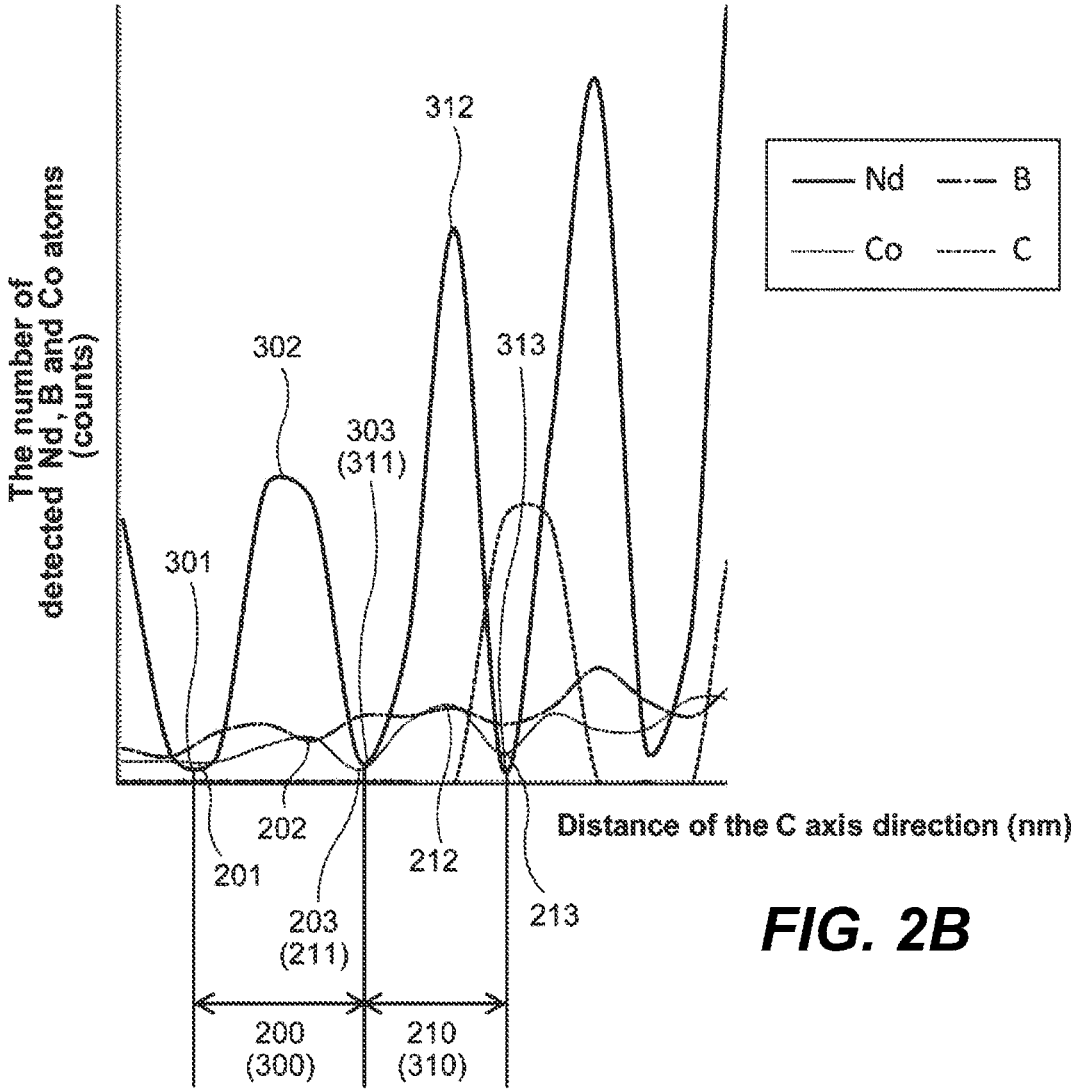
FIG. 2B

FIG. 3

UPPER FIELD CHARGE AMOUNT(wt%)
LOWER FIELD ACTUAL MEASURED VALUE(wt%)

| | | Nd | Tb | C | B | Al | Cu | Co | Nb | N | O | Fe | CARBON REDUCTION PROCESS | HEAT TREATMENT PROCESS |
|---|---|---|---|---|---|---|---|---|---|---|---|---|---|---|
| SET 1 | EXAMPLE 1 | 30.49 | – | – | 1.100 | 0.200 | 0.050 | 0.900 | – | – | – | RESIDUE | ○ | × |
| | | 29.78 | – | 0.049 | 1.100 | – | – | 0.890 | – | 0.019 | 0.17 | 67.70 | | |
| | COMPARATIVE EXAMPLE 1 | 30.49 | – | 0.150 | 0.950 | 0.200 | 0.050 | 0.900 | – | – | – | RESIDUE | ○ | × |
| | | 29.80 | – | 0.150 | 0.990 | – | – | 0.890 | – | 0.021 | 0.14 | 67.60 | | |
| SET 2 | EXAMPLE 2 | 30.49 | – | – | 0.900 | 0.200 | 0.050 | 0.900 | – | – | – | RESIDUE | ○ | × |
| | | 29.88 | – | 0.037 | 0.870 | – | – | 0.890 | – | 0.021 | 0.22 | 67.23 | | |
| | COMPARATIVE EXAMPLE 2 | 30.49 | – | 0.050 | 0.850 | 0.200 | 0.050 | 0.900 | – | – | – | RESIDUE | × | × |
| | | – | – | – | – | – | – | – | – | – | – | – | | |
| SET 3 | EXAMPLE 3 | 30.80 | – | – | 1.100 | 0.200 | 0.050 | 0.900 | 0.185 | – | – | RESIDUE | ○ | × |
| | | 29.76 | – | 0.037 | 1.090 | – | – | 0.900 | – | 0.014 | 0.014 | 67.14 | | |
| | COMPARATIVE EXAMPLE 3 | 30.80 | – | 0.075 | 1.025 | 0.200 | 0.050 | 0.900 | 0.185 | – | – | RESIDUE | ○ | × |
| | | 29.56 | – | 0.100 | 1.030 | – | – | 0.880 | – | 0.017 | 0.017 | 67.40 | | |
| | EXAMPLE 4 | 26.20 | 4.800 | – | 0.970 | 0.300 | 0.080 | 0.900 | 0.180 | – | – | RESIDUE | ○ | ○ |
| | | 26.12 | 4.300 | 0.030 | 0.940 | 0.380 | 0.090 | 0.850 | 0.180 | – | – | – | | |

| | | RESIDUAL MAGNETIC FLUX DENSITY [T] | COERCIVE FORCE [MA/m] | MAXIMUM ENERGY PRODUCT [kJ/m³] |
|---|---|---|---|---|
| SET 1 | EXAMPLE 1 | 1.40 | 0.666 | 318.12 |
| | COMPARATIVE EXAMPLE 1 | 1.38 | 0.797 | 353.35 |
| SET 2 | EXAMPLE 2 | 1.37 | 0.449 | 287.35 |
| | COMPARATIVE EXAMPLE 2 | 1.36 | 0.308 | 183.59 |
| SET 3 | EXAMPLE 3 | 1.42 | 0.752 | 380.96 |
| | COMPARATIVE EXAMPLE 3 | 1.41 | 0.833 | 378.40 |
| | EXAMPLE 4 | 1.28 | 2.328 | 319.10 |

FIG. 8A

| CRYSTAL PHASE | QUANTITATIVE VALUE(mass%) | LATTICE CONSTANT(Å) | | |
|---|---|---|---|---|
| | | a | b | c |
| $Nd_2Fe_{14}B$ | 93.78 | 8.8123 | 8.8123 | 12.206 |
| NdO AND OTHERS | | | | |

FIG. 8B

| CRYSTAL PHASE | Journal | LATTICE CONSTANT(Å) | | |
|---|---|---|---|---|
| | | a | b | c |
| $Nd_2Fe_{14}B$ | Shoemaker et al. Acta. Crystallogr. C40, 1665 (1984). | 8.804 | 8.804 | 12.205 |
| NdO | Leger et. al. J. Solid State Chem. 36, 261 (1981). | 4.994 | 4.994 | 4.994 |

FIG. 9

| SUBSTITUTION SITE | | S VALUE BEFORE SUB-STITUTION | S VALUE AFTER SUB-STITUTION | OCCUPANCY RATE OF ORIGINAL ATOMS | OCCUPANCY RATE OF Co ATOMS | JUDGMENT |
|---|---|---|---|---|---|---|
| Nd | 4f | 1.1907 | 1.1843 | 0.9748 | 0.0252 | ○ |
| Nd | 4g | | 1.1855 | 1.0196 | −0.0196 | × |
| Fe | 4c | | 1.1859 | −2.5829 | 3.5829 | △ |
| Fe | 16k | | 1.1847 | 2.8763 | −1.8763 | × |
| Fe | 16k | | 1.1849 | 2.8906 | −1.8906 | × |
| Fe | 8j | | 1.1870 | 0.0789 | 0.9211 | ○ |
| Fe | 8j | | 1.1863 | 2.8786 | −1.8786 | × |
| Fe | 4e | | 1.1861 | 4.3624 | −3.3624 | × |
| B | 4f | | 1.1854 | 0.9651 | 0.0349 | ○ |

FIG. 10
| SUBSTITUTION SITE | | S VALUE BEFORE SUB-STITUTION | S VALUE AFTER SUB-STITUTION | OCCUPANCY RATE OF ORIGINAL ATOMS | OCCUPANCY RATE OF Co ATOMS | JUDGMENT |
|---|---|---|---|---|---|---|
| Nd | 4f | 1.0195 | 1.0155 | 0.9767 | 0.0233 | ○ |
| Nd | 4g | | 1.0180 | 1.0104 | −0.0104 | × |
| Fe | 4c | | 1.0180 | −1.6646 | 2.6646 | △ |
| Fe | 16k | | 1.0137 | 3.4453 | −2.4453 | × |
| Fe | 16k | | 1.0090 | 4.3019 | −3.3019 | × |
| Fe | 8j | | 1.0185 | 0.1595 | 0.8405 | ○ |
| Fe | 8j | | 1.0178 | 2.7317 | −1.7317 | × |
| Fe | 4e | | 1.0178 | 3.7696 | −2.7696 | × |
| B | 4f | | 1.0181 | 0.9834 | 0.0166 | ○ |
FIG. 11A
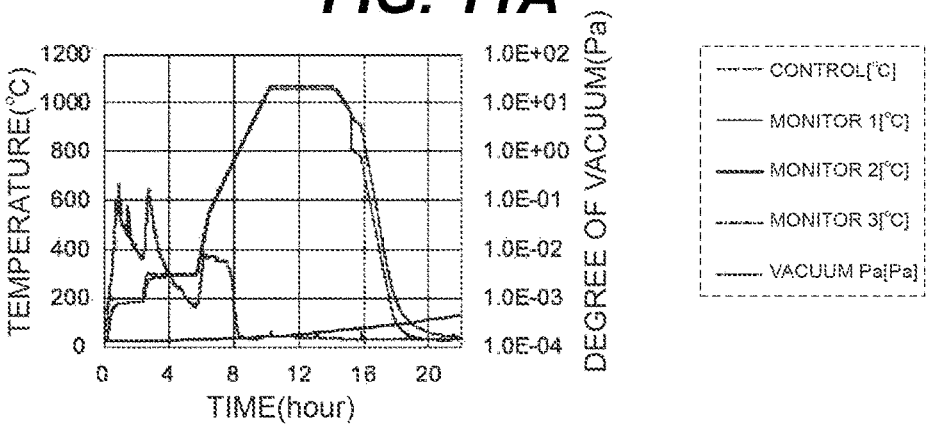
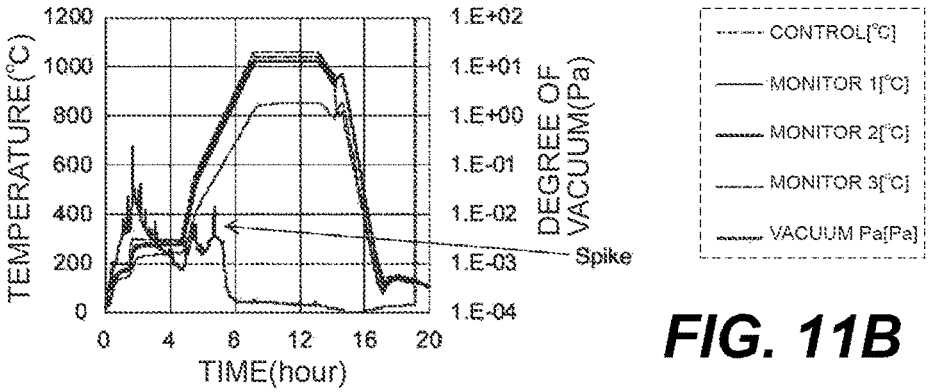
FIG. 11B

RARE EARTH PERMANENT MAGNET AND RARE EARTH PERMANENT MAGNET MANUFACTURING METHOD

TECHNICAL FIELD

The present disclosure relates to a rare earth permanent magnet containing a rare earth element (R), boron (B), and iron (Fe).

BACKGROUND ART

There are high demands for rare earth permanent magnets for the purposes of uses in automobiles, machine tools, wind power generators, and so on. Furthermore, technological developments relating to achievement of high performance, downsizing, and energy saving are required in order to optimize the rare earth permanent magnets for the respective uses. In order to satisfy these requirements, it is proposed to control fine structures by adjusting compositions of raw materials and manufacturing methods.

PTL 1 discloses a rare earth magnet mainly composed of R (where R is an element of one or more types selected from rare earth elements including Y and includes Nd as an essential component), B, Al, Cu, Zr, Co, O, C, and Fe, wherein content rates of the respective elements are as follows: 25 to 34 mass % of R, 0.87 to 0.94 mass % of B, 0.03 to 0.3 mass % of Al, 0.03 to 0.11 mass % of Cu, 0.03 to 0.25 mass % of Zr, 3 mass % or less of Co (excluding 0 mass %), 0.03 to 0.1 mass % of 0, 0.03 to 0.15 mass % of C, and the remainder of Fe.

However, factors that achieves the high performance of the rare earth permanent magnets have not been completely elucidated. Therefore, discussions about the means for enhancing magnetic performance have been continuing and such discussions and trials and errors are expected to provide a rare earth permanent magnet which exhibits further excellent performance.

CITATION LIST

Patent Literature

PTL 1: Japanese Patent Application Laid-Open (Kokai) Publication No. 2013-70062

SUMMARY OF THE DISCLOSURE

Problems to be Solved

It is an object of the present disclosure to provide a rare earth permanent magnet that exhibits high magnetic performance.

Means to Solve the Problems

An aspect of the present disclosure is a rare earth permanent magnet including a main phase containing: a rare earth element R of one or more types including Nd (neodymium); an element L of one or more types selected from a group consisting of Co (cobalt), Be (beryllium), Li (lithium), Al (aluminum), and Si (silicon); B (boron); and Fe (iron), wherein crystals which form the main phase belong to $P4_2/mnm$; some of B atoms occupying a 4f site of the crystals are substituted with atoms of the element L; each distribution of Nd atoms and the atoms of the element L appears along a C-axis direction of the crystals with periodic structure in a plurality of cycles; and the rare earth permanent magnet includes an area where a cycle of the atoms of the element L matches a cycle of the Nd atoms.

Effects of the Disclosure

The present disclosure can provide the rare earth permanent magnet which exhibits the high magnetic performance.

BRIEF DESCRIPTION OF DRAWINGS

FIGS. 2A and 2B are diagrams illustrating an element analysis result of an example of the present disclosure and a structural model of crystals which form a main phase of the present disclosure;

FIG. 3 is a chart illustrating compositions of examples of the present disclosure;

FIGS. 8A and 8B are Rietveld analysis results of an example of the present disclosure;

FIG. 9 is Rietveld analysis results of an example of the present disclosure;

FIG. 10 is Rietveld analysis results of an example of the present disclosure; and FIGS. 11A and 11B are diagrams for explaining a manufacturing method according to comparative examples of the present disclosure.

DESCRIPTION OF EMBODIMENTS

Figure 1A:
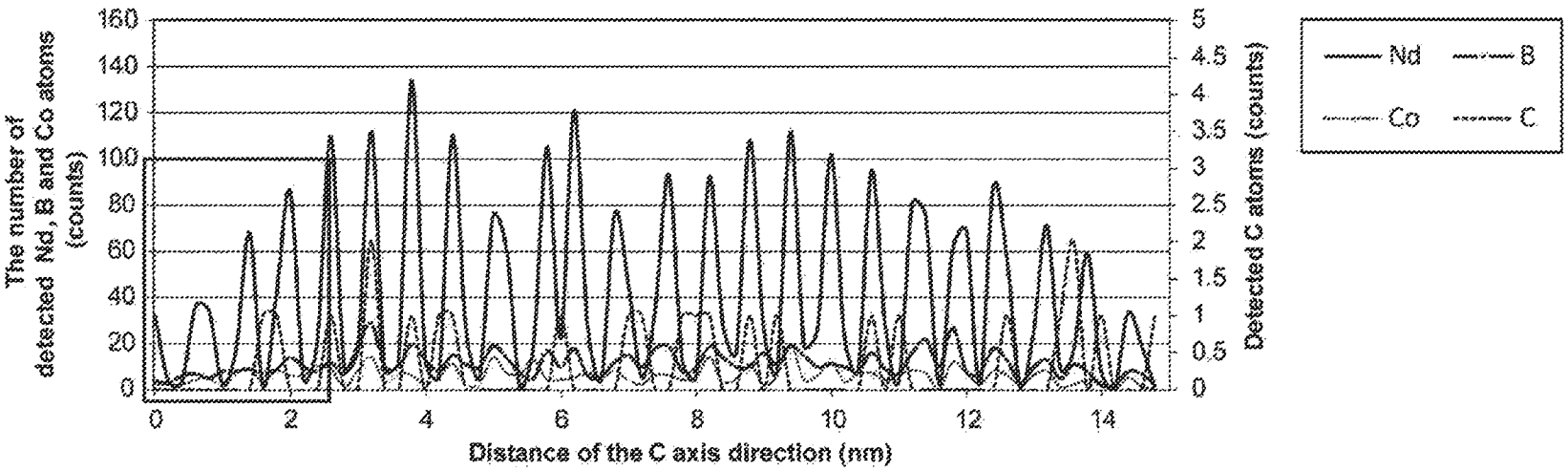
FIGS. 1A and 1B are element analysis results of examples of the present disclosure.

An embodiment of the present disclosure includes a main phase containing: a rare earth element R of one or more types including Nd; an element L of one or more types selected from a group consisting of Co, Be, Li, Al, and Si; B; and Fe, wherein crystals which form the main phase belong to $P4_2/mnm$; some of B atoms occupying a 4f site of the crystals are substituted with atoms of the element L; each distribution of Nd atoms and the atoms of the element L appears along a C-axis direction of the crystals in a plurality of cycles; and an area where a cycle of the atoms of the element L matches a cycle of the Nd atoms is included.

The main phase of the rare earth permanent magnet according to the present disclosure has a crystal structure in which R—Fe—B layers and Fe layers are layered alternately along the C-axis direction. In the above-described embodiment, all the B atoms occupying a specified site(s), except those required to maintain the crystal structure, can be substituted with the atoms of the element L.

Regarding the present disclosure, the carbon content in the main phase is an ultramicro amount. Accordingly, C atoms in the main phase can be hardly distributed at the site occupied by the B atoms. As a result, the atoms of the element L tend to be easily distributed at the site occupied by the B atoms. In other words, the present disclosure can promote substitution of the B atoms constituting the above-mentioned crystal structure with the atoms of the element L by suppressing the carbon content in the main phase. Consequently, the present disclosure can reduce suppression of the magnetic moment of the Nd atoms by the B atoms. As a result, residual magnetic flux density Br can be enhanced as the number of the B atoms substituted with the atoms of the element L is larger.

The carbon content in the main phase is reflected in a distribution status of the atoms of the element L in the main phase. Specifically speaking, when the carbon content is an ultramicro amount, the distribution of the atoms of the element L in the crystals of the main phase appears along the C-axis direction of the crystals in a plurality of cycles and there is an area where a cycle of the atoms of the element L matches a cycle of the Nd atoms. Regarding a method for analyzing the distribution status of atoms of the elements which constitute the present disclosure, Three-dimensional Atom Probe (3DAP) and a Rietveld method (Rietveld analysis) will be taken as examples. However, that analysis method is not limited to the methods explained as examples in this description.

In the present disclosure, a cycle of the atoms of the element constituting the main phase is defined based on the transition of the number of atoms of the relevant element in the C-axis direction of the crystals which form the main phase. Specifically speaking, one cycle of the atoms of the relevant element is a section from a first inflection point at which the number of atoms switches from a decrease to an increase through a second inflection point at which the number of atoms switches from the increase to a decrease to a third inflection point at which the number of atoms switches again from the decrease to an increase. When an n cycle and an (n+1) cycle are successive, the first inflection point of the (n+1) cycle matches the third inflection point of the n cycle.

Figure 1B:
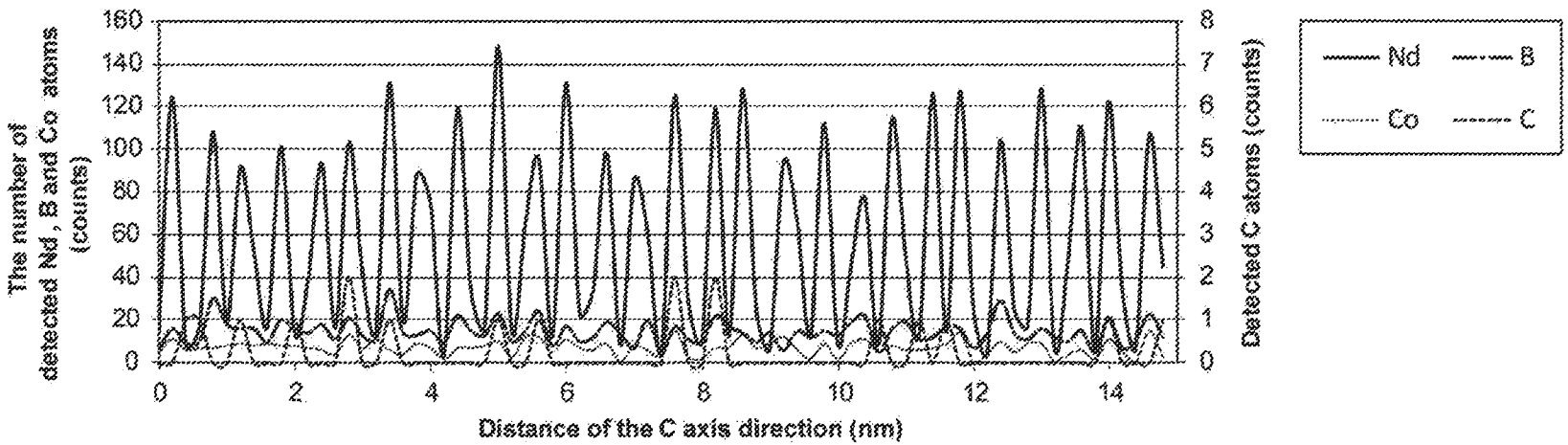

In the present disclosure, when the cycle of the atoms of the element L matches the cycle of the Nd atoms, it means a state where one second inflection point of the atoms of the element L is within one cycle of the Nd atoms. Such a state will be explained with reference to FIG. 1 and FIG. 2. FIG. 1 and FIG. 2 are analysis results by a 3DAP regarding the present disclosure. FIG. 1 is an element analysis result regarding the present disclosure. Regarding the element analysis performed to obtain FIG. 1, a distribution of atoms of an element group consisting of Nd, B, C, and Co with respect to crystals forming the main phase of the rare earth permanent magnet was observed along the C-axis direction of the crystals. FIG. 1A relates to Example 1 of the present disclosure and FIG. 1B relates to Comparative Example 1 of the present disclosure. In FIG. 1 and FIG. 2, Co is the element L.

FIG. 2 is created by enlarging and simplifying the part enclosed with a frame line in FIG. 1A. Also, FIG. 2A indicated above FIG. 2B is a diagram illustrating a structural model of the crystals which form the main phase in an embodiment of the present disclosure. Referring to FIG. 2A, the reference numeral 100 represents a crystal structure of a unit lattice. The crystal structure 100 corresponds to the analysis result indicated in FIG. 2B. Specifically speaking, an area where the Nd atoms and the B atoms are distributed at high concentration in FIG. 2B is indicated as an R—Fe—B layer(s) 101 in FIG. 2A. The reference numeral 102 represents an Fe layer(s). The relevant crystals have a layered structure, as illustrated in FIG. 2A, in which the Fe layers and the R—Fe—B layers are layered alternately along the C-axis direction. However, FIG. 2A is shown to explain that the crystal structure of the main phase has the layered structure and does not necessarily illustrate all the atoms constituting the above-described crystal structure.

Referring to FIG. 2B, the reference numeral 200 represents a first cycle of Co atoms. The reference numeral 201 represents a first inflection point of the cycle 200, the reference numeral 202 represents a second inflection point of the cycle 200, and the reference numeral 203 represents a third inflection point of the cycle 200. The reference numeral 300 represents a first cycle of the Nd atoms. The reference numeral 301 represents a first inflection point of the cycle 300, the reference numeral 302 represents a second inflection point of the cycle 300, and the reference numeral 303 represents a third inflection point of the cycle 300. However, in this description, the expressions "first," "second," and so on attached to the respective cycles in this description are used to distinguish these cycles from each other, but are not intended to characterize the respective cycles unless otherwise explained in this description. The second inflection point 202 in the cycle 200 of Co appears in the cycle 300 of the Nd atoms as illustrated in FIG. 2B. In other words, FIG. 1A and FIG. 2B illustrate the state where there is an area in which the cycle of Co matches the cycle of the Nd atoms.

Moreover, in the present disclosure, there appear a plurality of cycles of the constituent element group of the crystals forming the main phase. For example, referring to FIG. 2B, a second cycle 210 appeared successively following the first cycle 200 of the Co atoms. Specifically speaking, the third inflection point 203 in the cycle 200 is at the same time a first inflection point 211 in the cycle 210. The reference numeral 212 represents a second inflection point in the cycle 210 and the reference numeral 213 represents a third inflection point in the cycle 210. The third inflection point 203 in the first cycle 300 of the Nd atoms is at the same time a first inflection point 311 in a second cycle 310 of the Nd atoms. The reference numeral 312 represents a second inflection point in the cycle 310 and the reference numeral 313 represents a third inflection point in the cycle 310.

In some embodiments of the present disclosure, 15 or more cycles of the atoms of the element L match cycles of the Nd atoms. As this embodiment will be explained by referring to FIG. 2B, the inflection point 202 in the first cycle 200 of the Co atoms appeared still during the first cycle 300 of the Nd atoms. Also, the inflection point 212 in the second cycle 210 of the Co atoms appeared still during the second cycle 310 of the Nd atoms successively following the first cycle 300 of the Nd atoms. Specifically speaking, referring to FIG. 2B, the area where the cycle 200 and the cycle 210 appeared is an area where the Co atoms successively matched two cycles of the Nd atoms. Since FIG. 2B is a fragmentary enlarged view of FIG. 1A, it can be observed in actual Example 1, as illustrated in FIG. 1A, that the area where two or more cycles of the Co atoms successively match two or more cycles of the Nd atoms exists. In some embodiments of the present disclosure, 15 or more cycles of the atoms of the element L matchcycles of the Nd atoms.

Regarding the present disclosure including this embodiment, residual magnetic flux density Br is high. It is preferable that the number of the cycles of the atoms of the element L successively match the cycles of the Nd atoms be 15 cycles or more, more preferably 20 cycles or more, and further preferably 30 cycles or more. When the number of the cycles of the Nd atoms which successively match the cycles of the atoms of the element L is less than 15, invasion of the atoms of the element L into the main phase reduces and, therefore, there is a high possibility that the amount substituted with B atoms may become insufficient. In that case, it becomes difficult to remarkably enhance the magnetic performance. Meanwhile, in an embodiment where it is recognized that 50 or more cycles of the Nd atoms successively match 50 or more cycles of the atoms of the element L, it is presumed that there is theoretically a high possibility that the crystal structure of the above-mentioned main phase may not be maintained.

In some embodiments of the present disclosure, the area where the cycles of the atoms of the element L match the cycles of the Nd atoms can be defined by the distance of the C-axis direction of the crystals forming the main phase. In some embodiments of the present disclosure, the area where the cycles of the atoms of the element L match the cycles of the Nd atoms exists in the length of 7 nm or more along the C-axis direction of the crystals forming the main phase. In this embodiment, the definition of "the cycle(s) of the atoms of the element L matches the cycle(s) of the Nd atoms" has already been explained by taking an example of the relation between the first and second cycles of the Nd atoms and the inflection points of Co as illustrated in FIG. 2B. A case which falls under this embodiment is where when the cycles of the atoms of the element L successively match the cycles of the Nd atoms and the number of cycles is the number of the cycles of the Nd atoms and is defined as n, the distance from a first inflection point of a first Nd atom cycle, which is a first end, to a third inflection point of an n-th Nd atom cycle which is a second end on the opposite side of the first end of the relevant area as measured along the C-axis direction is 7 nm or more.

The above-described distance should preferably be 14 nm or more, more preferably 20 nm or more. When the distance is less than 7 nm, the invasion of the element L into the main phase becomes insufficient and, therefore, desired magnetic performance can hardly be exhibited.

Regarding the crystals which form the main phase of the present disclosure, there exist two 16k sites, two 8j sites, one 4g site, two 4f sites, one 4e site, and one 4c site. In the following explanation, when there are a plurality of sites like the 16k sites, the sites may sometimes be described as a first 16k and a second 16k. However, the expressions "first," "second," and so on are used to distinguish the sites and are not intended to characterize the respective sites unless otherwise explained in this description.

In the present disclosure, some of the B atoms occupying the 4f site are substituted with the element L. Moreover, in some embodiments of the present disclosure, not only the B atoms occupying the 4f site, some of atoms of one or more types selected from a group consisting of the Nd atoms occupying the 4f site of the crystals belonging to $P4_2/mnm$ and Fe atoms occupying the 8j site are substituted with the atoms of the element L. Incidentally, in some embodiments of the present disclosure, the possibility of some of the Fe atoms occupying the 4c site being substituted with the atoms of the element L cannot necessarily be excluded.

Regarding the layered structure of the R—Fe—B layers and the Fe layers, atoms of the element R occupying the first 4f site and the 4g site, the Fe atoms occupying the 4c site, and the B atoms occupying the second 4f site form the R—Fe—B layer. The Fe atoms occupying two 16k sites, two 8j sites, and a 4e site form the Fe layer.

In some embodiments of the present disclosure, whether some of the specified atoms are substituted with the atoms of the element L or not is judged by the Rietveld method. Specifically speaking, whether the substitution is performed or not is judged based on a space group of the crystals forming the main phase which is specified by analysis and occupancy rates of the respective elements at each site existing in the space group. However, the present disclosure does not exclude the judgment on whether the specified atoms in the crystal structure of the rare earth permanent magnet are substituted or not, according to a method different from the Rietveld method.

Regarding the above-mentioned judgment on the substitution by the atoms of the element L, an explanation will be provided by taking, as an example, an embodiment in which the B atoms occupying the 4f site of $P4_2/mnm$ are substituted with the atoms of the element L. The same method can be also used for the judgment on the substitution of atoms occupying other sites including a case where the Nd atoms occupying the 4f site and the Fe atoms occupying the 8j site are substituted.

The crystals which form the main phase of the present disclosure belong to $P4_2/mnm$. An occupancy rate of the atoms of the element L of the relevant space group at the 4f site of occupied by the B atoms is defined as p. When the occupancy rate which is defined as p is expressed in percentage, it is expressed as $(p\times100)\%$. When the occupancy rate is $p>0.000$, it can be judged that some of the B atoms occupying the 4f site are substituted with the atoms of the element L. On the other hand, when the occupancy rate is $p\leq0.000$, it can be judged that some of the B atoms occupying the 4f site are not substituted with the atoms of the element L Furthermore, even when the occupancy rate is $p>0.000$, if the occupancy rate of the substituted atoms becomes a negative value, it lacks physical consistency and, therefore, it is sometimes impossible to judge whether the substitution has been performed or not. Incidentally, the occupancy rate of the B atoms which occupy the 4f site together with the atoms of the element L is defined as $1.000-p$; and when this occupancy rate of the B atoms is expressed in percentage, it is expressed as $[(1.000-p)\times100]\%$.

An upper limit of the occupancy rate p of the atoms of the element L is not limited as long as the crystal structure of the main phase is maintained. Regarding the element L which substitutes the B atoms occupying the 4f site, an embodiment in which p is calculated within the range of $0.030\leq p\leq0.100$ is preferred. From the viewpoint of reliability of the analysis result, an s value is 1.3 or less; and the s value closer to 1 is more preferable and the most preferable s value is 1. The s value is a value which can be obtained by dividing an R-weighted pattern ($R_{wp}$) of the reliability factor R by R-expected ($R_e$).

An embodiment of the present disclosure includes the main phase containing one or more types of selected rare earth element(s) R including Nd, the element of one or more types selected from a group consisting of Co, Be, Li, Al, and Si, B, and Fe. In the present disclosure, the rare earth elements R are Nd, Pr (praseodymium), Dy (dysprosium), Tb (terbium), Sm (samarium), Gd (gadolinium), Ho (holmium), and Er (erbium). Pr is preferred as the rare earth element to be used together with Nd from the viewpoint of reduction of the manufacturing cost. However, if the content of the rare earth elements other than Nd becomes too large, there is a high possibility that the residual magnetic flux density Br may reduce. Therefore, a preferred ratio of the number of atoms of Nd to the other rare earth elements R is 80:20 to 70:30. Furthermore, in this description, the element of one or more types selected from the group consisting of Tb, Sm, Gd, Ho, and Er may sometimes be described as element A as an element which contributes to enhancement of the magnetic performance.

Some embodiments of the present disclosure contain the element A of one or more types selected from the group consisting of Tb, Sm, Gd, Ho, and Er. The present disclosure can further enhance the residual magnetic flux density Br by containing Sm and Gd. Also, the present disclosure can enhance a coercive force Hcj by containing Tb, Ho, and Er. Therefore, both the residual magnetic flux density Br and the coercive force Hcj can be enhanced by reducing the carbon content, substituting B with the specified element L, and containing the element A. The element A can be substituted with Fe.

The ratio of the number of atoms of B to the element L (B:element L) is expressed as $(1-x):x$, where x satisfies $0.01 \leq x \leq 0.25$, preferably $0.03 \leq x \leq 0.25$. In a case of $x<0.01$, the magnetic moment reduces. In a case of $x>0.25$, the specified crystal structure cannot be maintained.

In some embodiments of the present disclosure, this embodiment not only suppresses the B content, but also controls the carbon content and thereby suppresses the invasion of the C atoms into the main phase in order to obtain the crystal structure to substitute the B atoms with the atoms of the element L. Known methods for controlling the carbon content include selection of materials for jigs, indirect heating, and no gas flow etc. However, it is preferable that the above-listed known control methods and a new different method be combined in order to manufacture some embodiments of the present disclosure. As some embodiments of the present disclosure are manufactured through the process of the new method, they can reduce the carbon content in the main phase and include a specified element distribution. The new method for controlling the carbon content relating to the present disclosure will be explained later.

In some embodiments of the present disclosure, an unsubstituted element L which has not been substituted with any of the rare earth element R, Fe, or B, the element A, and also other elements contained in the raw material alloy exist in any one of the sites of the Nd—Fe—B layer. Examples of the other elements include known elements which enhance the magnetic performance of the rare earth permanent magnet. Furthermore, elements which form a grain boundary phase such as Cu, Nb, Zr, Ti, and Ga, and elements which form a subphase such as O (oxygen) may sometimes enter any one of the sites of the crystal structure of the main phase.

In some embodiments of the present disclosure, a composition of the respective elements contained in the present disclosure is as follows: the content of the rare earth element R excluding the element A to the entire weight of the rare earth element is 20 to 35 wt %, preferably 22 to 33 wt %. The B content is 0.80 to 1.1 wt %, preferably 0.82 to 0.98 wt %.

The total content of the element of one or more types selected from a group consisting of Co, Be, Li, Al, Si, Cu, Nb, Zr, Ti, and Ga is 0.8 to 2.0 wt %, preferably 0.8 to 1.5 wt %. Regarding the group of the above-listed elements, an element group consisting of Co, Be, Li, Al, and Si can invade, as the element L, into the main phase and substitute the specified B atoms. Furthermore, an element group consisting of Al, Cu, Nb, Zr, Ti, and Ga can precipitate as the grain boundary phase or the subsidiary phase. Regarding an element like Al which belong both the above two element groups, which one of the main phase, the grain boundary phase, and the subphase it should be contained in is determined depending on manufacturing conditions.

The total content of the element A of one or more types selected from a group consisting of Tb, Sm, Gd, Ho, and Er is 2.0 to 10.0 wt %, preferably 2.6 to 5.4 wt %. The residue is Fe. The present disclosure may sometimes contain C in an unavoidable amount in terms of manufacture. However, the content of C is a trace amount, preferably 0.09 wt % or less, more preferably 0.05 wt % or less, or further preferably 0.03 wt % or less. In the present disclosure, most of the C atoms exist in the grain boundary phase and the C atoms which invade into the main phase are of an ultramicro amount. Therefore, the C atoms do not exert any significant influence on the magnetic performance.

By preparing the composition to be within the above-described range, the present disclosure includes the main phase formed by crystals in which the elements are distributed in some specified forms. Consequently, good residual magnetic flux density Br and coercive force Hcj are exhibited. Regarding the composition of the present disclosure, the content of each element is an actual measured value of the present disclosure. Regarding measurement equipment, an ICP emission spectrometer ICPS-8100 by SHIMADZU CORPORATION can be indicated as an example. Moreover, regarding equipment to be used for composition analysis of trace-amount elements in the main phase such as C, N, and O, LEAP3000XSi by AMETEK can be indicated as an example. When LEAP3000XSi by AMETEK is used, the analysis can be performed by setting a laser pulse mode (laser wavelength=532 nm), laser power=0.5 nJ, and a sample temperature=50 K. When the actual measured value is unknown, a charge amount of the raw material alloy prepared when manufacturing the relevant rare earth permanent magnet is considered to be the actual measured value of each element in the rare earth permanent magnet. The relevant charge amount is the content of an element source in raw material metals to be added to the raw material alloy.

The present disclosure has high residual magnetic flux density Br and can further have a high coercive force Hcj and a large maximum energy product $BH_{max}$. Moreover, when the present disclosure contains, for example, Ho as the element A, it also has excellent heat resistance.

[Rare Earth Permanent Magnet Manufacturing Method]

A rare earth permanent magnet manufacturing method of the present disclosure is not particularly limited as long as it can provide operational advantages of the present disclosure. An embodiment of the present disclosure regarding the rare earth permanent magnet manufacturing method includes a carbon reduction step and a degreasing step. The carbon content which invades into the main phase can be reduced by providing the carbon reduction process. As a result, specified atoms in the main phase can be easily substituted with the atoms of the element L.

The present disclosure is a rare earth permanent magnet manufacturing method including: a degreasing process of retaining, in vacuum, a green compact of a raw material alloy containing a rare earth element R of one or more types including Nd, an element of one or more types selected from a group consisting of Co, Be, Li, Al, Si, Cu, Nb, Zr, Ti, and Ga, B, and Fe; and a carbon reduction step of reducing a carbon content in the green compact before the degreasing process.

In some embodiments of the present disclosure, the carbon reduction process includes a degassing step of retaining the green compact at a temperature of 100° C. or lower for one hour or longer before the degreasing step. In some embodiments of the present disclosure, the carbon reduction step includes a drying process of retaining the green compact in an atmosphere of a dew point of −60° C. or lower before the degreasing step. In some embodiments of the present disclosure, the drying process is performed after the degassing process.

In the present disclosure, a fine mill process of the raw material alloy and magnetic field press process are performed before the carbon reduction process. The green compact of the raw material allow is produced by these processes. In each of the processes, for example, materials to be carbon sources such as oil added as a binder and oil from equipment, plastics, and paper are used. Also, matters attached to the inside of a furnace can be the carbon sources. The present disclosure reduces the binder to be added to the green compact by executing the degassing step and the drying step on the green compact. Furthermore, any contact between the green compact and the carbon sources is avoided during these steps to the extent possible. As a result, the present disclosure can produce the green compact with a small carbon content. Regarding the rare earth permanent magnet which is made of the above-mentioned green compact, the C atoms can hardly invade into the main phase. Therefore, in the present disclosure, the substitution of the specified B atoms constituting the main phase by the atoms of the element L is promoted. As a result, the present disclosure can manufacture a rare earth permanent magnet which exhibits high residual magnetic flux density Br.

Some embodiments of the present disclosure include: a sintering process of sintering the green compact after the degreasing process; and a heat treatment process of applying a heat treatment to a sintered compact produced in the sintering process at a temperature lower than a sintering temperature. As a result of this, the grain boundary phase and the subsidiary phase precipitate other than the main phase, thereby making it possible to manufacture a rare earth permanent magnet with further excellent magnetic performance.

[Micronization Step]

The raw material alloy is prepared at a stage prior to the fine mill process. The raw material alloy is obtained by: charging raw material metals containing the rare earth element R of one or more types including Nd, the element of one or more types selected from a group consisting of Co, Be, Li, Al, Si, Cu, Nb, Zr, Ti, and Ga, Fe, and B so that the respective elements mentioned above will be contained at a specified stoichiometric ratio; and dissolving the charged raw material metals.

The stoichiometric ratio of the raw material alloy is almost the same as the composition of the rare earth permanent magnet which is an end product. Therefore, a blending ratio of the raw material materials used for the raw material alloy is determined according to a desired composition of the rare earth permanent magnet. It is preferable that the raw material alloy should not be an amorphous alloy. It is also preferable that the element A of one or more types selected from a group consisting of Tb, Sm, Gd, Ho, and Er should be contained in the raw material alloy in order to enhance the magnetic performance.

In the fine mill process, the raw material alloy is coarsely ground, for example, in an inert gas atmosphere such as argon by using a ball mill, a jet mill, or so on. It is preferable that the raw material alloy be embrittled before it is coarsely ground. A powder particle size $D_{50}$ of alloy particulates is preferably 2 to 25 μm, more preferably 2 to 18 μm, and further preferably 2 to 15 μm. In this embodiment, $D_{50}$ is a median diameter in cumulative distribution of an alloy particulate group on the volume-basis. The powder particle size of the alloy particulates is not particularly limited and can be measured by using, for example, a laser diffraction type particle size analyzer (SALD3100 by SHIMADZU CORPORATION). By employing the powder particle size within the above-mentioned preferable range, it becomes easier to sintered particle refinement of the sintered compact, which is obtained by sintering the raw material alloy, into a desired sintered particle size. It is also preferable that the raw material alloy particulates which have been coarsely ground should be further fine-milled by using the ball mill, the jet mill, or the like.

[Molding Process in Magnetic Field]

In the molding process in the magnetic field, the obtained raw material alloy particulates are compression-molded in a magnetic field. This process should preferably be executed with the magnetic field intensity of between 0.8 MA/m and 4.0 MA/m, inclusive, and the pressure of between 1 MPa and 200 MPa, inclusive. There is no particular limitation on a binder as long as it can exert the operational advantages of the present disclosure; and an example of the binder can be a fatty acid ester diluted with a solvent. Examples of the fatty acid ester can include methyl caproate, methyl caprylate, methyl laurate, and lauryl methyl sulfate. Examples of the solvent can include petroleum solvents represented by isoparaffin and naphthene solvents. A mixture example of the fatty acid ester and the solvent can be a mixture with a weight ratio of 1:20 to 1:1. Additionally, 1.0 wt % or less an arachic acid may be contained as a fatty acid. Moreover, a solid lubricant such as zinc stearate may be also used instead of a liquid lubricant or together with the liquid lubricant.

[Carbon Reduction Process (Degassing Step)]

The present disclosure can reduce the carbon content in the green compact by executing the degassing step and the drying step outside a sintering furnace before the degreasing step as compared to the case where only the degreasing step is executed before the sintering step. The reduction of the carbon content can be implemented by executing either one of the degassing step and the drying step, but both the steps may be executed. When both the steps are executed, the drying step should preferably be executed after the degassing step. By executing the carbon reduction step, the carbon content in the rare earth permanent magnet becomes an ultramicro amount and the carbon content becomes less than the carbon content of the case where the carbon atoms can easily invade into the main phase of the rare earth permanent magnet. In other words, it becomes difficult for the C atoms to invade into the main phase by executing the carbon reduction step according to the present disclosure, this makes it easier for the specified the B atoms to be substituted with the atoms of the element L.

In the degassing step, the green compact is placed in a sealable treatment container and is retained under a temperature condition of 100° C. or lower, preferably 40° C. or lower, or more preferably 30° C. or lower. In this step, the carbon content can be reduced more when the retention time is longer. On the other hand, if the retention time is too long, evaporation of the binder proceeds, so that a protective membrane of the green compact will be lost. Therefore, from the viewpoint of effective reduction of the carbon content and avoidance of oxidation of the green compact, the retention time is one hour or more, preferably 6 hours or more, or more preferably between 12 hours and 24 hours, inclusive. In some embodiments of the present disclosure, when the degassing step is executed for the above-described preferable retention time, a weight reduction rate after the degassing step to the weight of the green compact before the degassing step is approximately 20% to 40% inclusive. In this case, it is possible to maintain the state where the binder in the amount which can become the protective membrane is attached to the particles in the green compact.

[Carbon Reduction Process (Drying Step)]

In the drying step, the green compact is placed in the sealable treatment container and is retained by keeping the inside of the treatment container in a low humidity environment. When the drying step is executed after the degassing step, the drying step may be executed continuously in the same treatment container where the degassing step has been executed. In the present disclosure, the low humidity environment means the atmosphere where the dew point is −60° C. or lower, preferably −80° C. or lower, or more preferably −110° C. or lower. The retention time is preferably between 6 hours and 96 hours, inclusive, or more preferably between 24 hours and 96 hours, inclusive. Consequently, the carbon content is reduced and the green compact which hardly oxidizes can be produced. When the retention time is less than 24 hours, the property will degrade due to oxidization. Furthermore, when the retention time exceeds 96 hours, the magnetic property will degrade due to oxidization.

[Carbon Reduction Process (Degreasing Step)]

After the carbon reduction step, the green compact is moved to a sintering furnace and the degreasing step is started. In the degreasing step, it is preferable that temperature management in a single stage or a plurality of stages be performed in order to degrease the entire green compact uniformly and the degree of vacuum within the sintering furnace be maintained at 10 Pa or less, preferably $10^{-2}$ Pa or less. Accordingly, the carbons remaining in the green compact after the carbon reduction step can be further reduced and the main phase of the rare earth permanent magnet can be made to have the crystal structure with desired element distribution.

A preferred example of the temperature management is to maintain the temperature at between 50° C. and 150° C., inclusive, for not less than one hour and not more than four hours and then raise and maintain the temperature at between 150° C. and 250° C., inclusive, for not less than one hour and not more than four hours. When an internal furnace temperature of the first stage is set to be lower than 50° C., oxidation and degreasing time of the green compact within the furnace is unbalanced and the green compact tends to be easily oxidized. When the internal furnace temperature is set at 150° C. or higher, thermal decomposition of the binder proceeds rapidly (the pressure increases in a spike manner), the degree of vacuum tends to easily decrease, and it becomes difficult to maintain a desired degree of vacuum. When the internal furnace temperature at the second and subsequent stages is set to be lower than 150° C., degreasing has been performed in the first stage, but decreasing in the second stage requires time and, therefore, oxidation tends to be caused easily. When the internal furnace temperature is set at 250° C. or higher, the degree of vacuum tends to easily decreases and it becomes difficult to maintain the desired degree of vacuum.

[Sintering Process]

The sintering step is executed by retaining the green compact inside the sintering furnace after the degreasing step and raising the internal furnace temperature. The main phase of the rare earth permanent magnet specified by the present disclosure can be formed by executing the sintering step. The present disclosure executes the above-described carbon reduction step before placing the green compact in the sintering furnace. Accordingly, spike waveforms hardly occur in transition of the degree of vacuum within the sintering furnace. In other words, the rare earth permanent magnet can be manufactured by maintaining the safety of an internal furnace environment of the sintering furnace. The temperature management within the sintering furnace in the sintering step and the heat treatment step is decided based on melting points of components of the green compact.

An example of the temperature management within the sintering furnace in the sintering step of the present disclosure can be an embodiment in which the temperature is retained at between 1000° C. and 1200° C., inclusive, for not less than 2 hours and not more than 11 hours. Another preferred example of the temperature management can be to retain the sintering temperature at between 1000° C. and 1100° C., inclusive, and for not less than 3 hours and not more than 7 hours.

As a result, an embodiment of the present disclosure can manufacture the rare earth permanent magnet including the main phase, in high density, containing the rare earth element R of one or more types including Nd, the element L, B, and Fe, wherein its crystals belong to $P4_2/mnm$; some of B atoms occupying the 4f site of the crystals are substituted with atoms of the element L; each distribution of the Nd atoms and the atoms of the element L appears along the C-axis direction of the crystals in a plurality of cycles; and the main phase includes an area where a cycle(s) of the atoms of the element L matches a cycle(s) of the Nd atoms is included. When the temperature conditions and the retention time of the above-described preferred examples of the temperature management are not satisfied, it becomes difficult to form the specified main phase of the present disclosure.

Regarding the main phase formed by some embodiments of the present disclosure, 15 or more cycles of the atoms of the element L successively match 15 or more cycles of the Nd atoms in the above-described area where the cycles of the atoms of the element L match the cycles of the Nd atoms. Furthermore, regarding the main phase formed by some embodiments of the present disclosure, the distance of the C-axis direction of the relevant crystals in the area where the cycles of the atoms of the element L match the cycles of the Nd atoms is 7 nm or more.

Regarding the main phase formed by some embodiments of the present disclosure, the main phase in which some of atoms of one or more types selected from a group consisting of not only the B atoms occupying the 4f site of the crystals belonging to $P4_2/mnm$, but also the Nd atoms occupying the 4f site, the Fe atoms occupying the 4c site, and the Fe atoms occupying the 8j site are substituted with the atoms of the element L is formed according to the composition of the raw material alloy, the conditions of the carbon reduction step, and the temperature management of each step. Additionally, the present disclosure also includes an embodiment that forms the main phase containing the element A when the element A is added to the raw material alloy.

When any one of the main phases illustrated as examples above is formed, the present disclosure can also enhance the residual magnetic flux density Br, the coercive force Hcj, the maximum energy product BHmax, and the mechanical strength of the rare earth permanent magnet.

[Heat Treatment Process]

The heat treatment step is executed after the sintering step by setting the internal furnace temperature at a specified heat treatment temperature. The grain boundary phase and the subsidiary phase can be made to precipitate around the main phase of the specified rare earth permanent magnet of the present disclosure by executing the heat treatment step.

The heat treatment step is executed in a single stage or a plurality of stages. An example of the temperature management inside the sintering furnace in the heat treatment step can be to retain the temperature at between 400° C. and 1100° C., inclusive, and for not less than 2 hours and not more than 9 hours. According to the present disclosure, Cu, Nb, Zr, Ti, Ga, etc. can be contained in the grain boundary phase. A phase containing oxygen and so on can precipitate as the subsidiary phase.

In some embodiments of the present disclosure, the heat treatment step is executed after the sintering step and the internal furnace temperature is further controlled in a state of maintaining the degree of vacuum and eventually decreased to room temperature, and then the green compact is sintered to manufacture the rare earth permanent magnet. The above-described temperature control causes the grain boundary phase and the subsidiary phase to precipitate in a metallographic structure.

An average sintered particle size in some embodiments of the present disclosure is 110 to 130% of a powder particle size of the green compact and can be 110 to 180% of the powder particle size of the green compact. The average sintered particle size is preferably between 2.2 μm and 20 μm, inclusive, more preferably between 2.2 μm and 15 μm, inclusive, or further preferably between 2.2 μm and 10 μm, inclusive. When the average sintered particle size exceeds 20 μm, the coercive force Hcj degreases significantly. In the present disclosure, the average sintered particle size is an average value of a major axis of a particle group constituting the sintered compact. The major axis of the particle group constituting the sintered compact can be measured by observation with an optical microscope or image analysis of sectional images obtained by a scanning electron microscope.

Sintered density in some embodiments of the present disclosure is 6.0 to 8.0 g/cm$^3$ and may sometimes become 7.2 to 7.9 g/cm$^3$. When the sintered density is less than 6.0 g/cm$^3$, there will be many voids in the sintered compact. As a result, the residual magnetic flux density Br and the coercive force Hcj of the rare earth permanent magnet decrease.

EXAMPLES

This embodiment will be further explained by referring to the following examples. However, this embodiment is not limited to the following examples.

Examples 1 to 4 and Comparative Examples 1 to 3

Example 1 to Example 4 and Comparative Example 1 to Comparative Example 3 were manufactured and the magnetic performance was measured. Example 1 to Example 3 and Comparative Example 1 to Comparative Example 3 constitute Set 1 composed of Example 1 and Comparative Example 1, Set 2 composed of Example 2 and Comparative Example 2, and Set 3 composed of Example 3 and Comparative Example 3. Regarding Example 1, Comparative Example 1, and Example 4, element analysis of the main phase by a 3DAP and crystal structure analysis of the main phase by the Rietveld method were conducted.

Chemical composition of charged amount of the raw material alloy for each of Examples and Comparative Examples was decided in accordance with a desired composition of the rare earth permanent magnet. FIG. 3 is a table illustrating the compositions of examples of the present disclosure. When "–" is indicated in an upper field, it means that "the raw material metal which becomes the element source was not added." A lower field is for an actual measured value of the element to be contained in the rare earth permanent magnet, which was measured by using an ICP emission spectral analysis method (Inductively Coupled Plasma Atomic Emission Spectroscopy: ICP-AES); and when "–" is indicated in the lower field, it means that "the relevant element was not detected" or "the relevant element has not been measured yet."

A manufacturing method of Example 1 will be explained. A raw material alloy prepared with the charged composition described in FIG. 3 was coarsely ground with a ball mill, thereby obtaining alloy particles. Then, the alloy particles were dispersed in a solvent. An additive was introduced to the dispersed solution, which was then stirred to cause a reduction, thereby micronizing the alloy particles. A molding cavity was loaded with the micronized raw material alloy and the binder and molding in a magnetic field was performed at 0.8 MA/m or more and 20 MPa, thereby preparing the green compact.

The carbon reduction step was executed by placing the green compact in a glove box. In the carbon reduction step, the degassing step and the drying step were executed. In the degassing step, a temperature condition of 25° C. was retained for 24 hours. Then, the drying step was executed within the same glove box. In the drying step, the atmosphere at a dew point of −80° C. was retained for 24 hours.

After the drying step terminated, the green compact was moved from the glove box to the sintering furnace and the degreasing step was started. In the degreasing step, the internal furnace temperature was set and maintained at 200° C. for 3 hours and then set and maintained at 300° C. for 3 hours in order to cause the degree of vacuum to reach $10^{-2}$ Pa.

Figure 4:
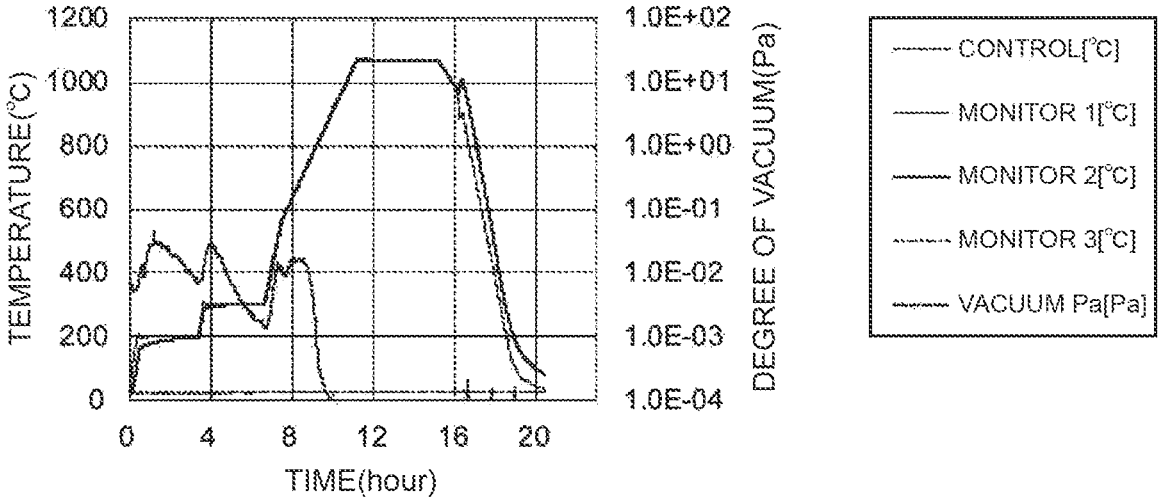
FIG. 4 is a diagram for explaining a manufacturing method according to an example of the present disclosure.

After the degreasing step terminated, the sintering step was executed. In the sintering step, the internal furnace temperature was set and maintained at 1070° C. for 4 hours. FIG. 4 illustrates a profile of the temperature and the degree of vacuum in the degreasing step and the sintering step of Example 1. The sintered compact was taken out of the sintering furnace, thereby obtaining Example 1. There was a tendency that the metallographic structure of Example 1 was composed generally of the main phase.

Figure 5:
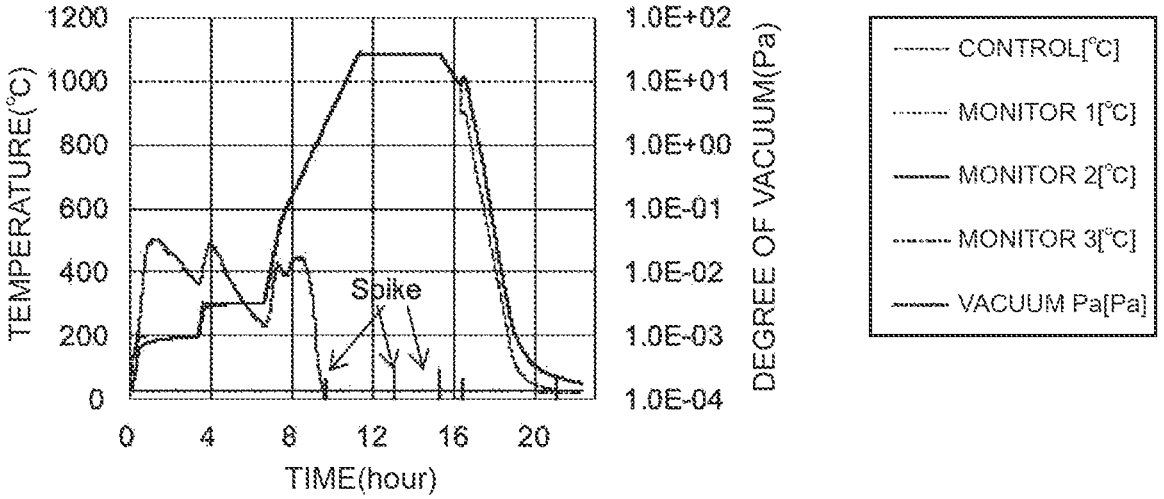
FIG. 5 is a diagram for explaining a manufacturing method according to a comparative example of the present disclosure.

In Comparative Example 1, a raw material alloy with the composition indicated in FIG. 3 was used and the micronization step, the molding step in the magnetic field, the degassing step, the drying step, and the degreasing step were executed under the same conditions as in Example 1. FIG. 5 illustrates a profile of the temperature and the degree of vacuum in the degreasing step and the sintering step of Comparative Example 1. In the sintering step of Comparative Example 1, the internal furnace temperature was maintained at 1080° C. for 4 hours as illustrated in FIG. 5. There was a tendency that the metallographic structure of Comparative Example 1 was composed generally of the main phase.

In Example 2 and Comparative Example 2, raw material alloys with the compositions indicated in FIG. 3 were used and the micronization step, the molding step in the magnetic field, the degreasing step, and the sintering step were executed under the same conditions as in Example 1. In Example 2, the degassing step and the drying step were executed under the same conditions as in Example 1. On the other hand, in Comparative Example 2, neither the degassing step nor the drying step was executed. In both Example 2 and Comparative Example 2, there was a tendency that the metallographic structure was composed generally of the main phase.

In Example 3 and Comparative Example 3, raw material alloys with the compositions indicated in FIG. 3 were used and the micronization step, the molding step in the magnetic field, the degassing step, the drying step, the degreasing step, and the sintering step were executed under the same conditions as in Example 1. In both Example 3 and Comparative Example 3, there was a tendency that the metallographic structure was composed generally of the main phase.

In Example 4, a raw material alloy with the composition indicated in FIG. 3 was used and the micronization step, the molding step in the magnetic field, the degassing step, and the drying step were executed under the same conditions as in Example 1. In the degreasing step, the internal furnace temperature was set and maintained at 200° C. for one hour and then set and maintained at 300° C. for 3 hours in order to cause the degree of vacuum to reach $10^{-2}$ Pa. In the sintering step, the internal furnace temperature was maintained at 1060° C. for 4 hours. Subsequently, the heat treatment step was executed. Regarding the metallographic structure of Example 4, there was a tendency that the grain boundary phase and the subsidiary phase were also formed other than the main phase.

Figures 6, 7:
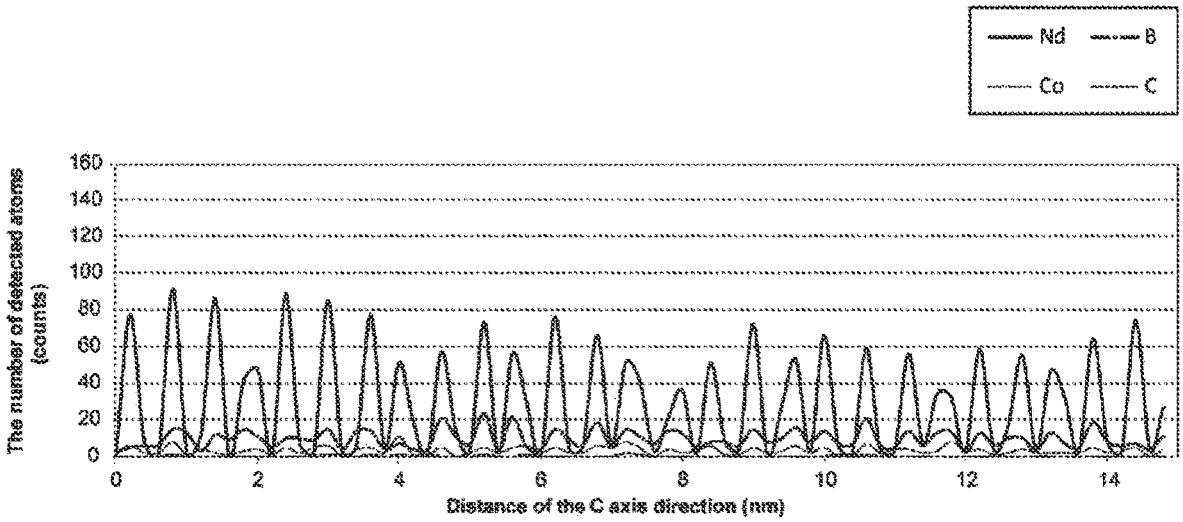
FIG. 6 is a chart illustrating magnetic performance measurement results of examples of the present disclosure.
FIG. 7 is an element analysis result of an example of the present disclosure.

FIG. 6 illustrates the magnetic performance of Example 1 to Example 4 and Comparative Example 1 to Comparative Example 3. An apparatus equivalent to TPM-2-08S pulsed high field magnetometer equipped with a sample temperature variable device by TOEI INDUSTRY CO., LTD. was used as measurement equipment. The carbon content of Examples was less than that of Comparative Examples in either one of Set 1 to Set 3 as illustrated in FIG. 3. Accordingly, as illustrated in FIG. 6, the residual magnetic flux density Br of each Example became higher than that of Comparative Example belonging to the same set.

The element distribution in the C-axis direction was analyzed with respect to the crystals of the main phase in Example 1, Comparative Example 1, and Example 4 by using the 3DAP. Equipment and measurement conditions used for the analysis are described below.

Equipment Name: LEAP3000XSi (by AMETEK)

Measurement Conditions: laser pulse mode (laser wavelength=532 nm)

laser power=0.5 nJ, sample temperature=50K

FIG. 1 illustrates element analysis results of Example 1 and Comparative Example 1 and FIG. 1A illustrates the element analysis result of Example 1 and FIG. 1B illustrates the element analysis result of Comparative Example 1. As a result of comparison between FIG. 1A and FIG. 1B, FIG. 1A regarding Example 1 shows that cycles of both Co and Nd appeared successively. Also, 24 cycles of Co successively matched 24 cycles of the Nd atoms. Furthermore, the distance of the C-axis direction of the crystals in the area where the cycles of the Co atoms matched the cycles of the Nd atoms was 14 nm or more. On the other hand, FIG. 1B regarding Comparative Example 1 shows that the cycles of Co did not appear so notably as in FIG. 1A. Accordingly, there were less areas in Comparative Example 1 than in Example 1 where the cycles of Co matched the cycles of the Nd atoms, and the distance of the C-axis direction of the crystals in the relevant area was shorter than that in Example 1.

Example 1 was prepared by adjusting, for example, the amount of carbons included in raw materials containing the carbons such as pure iron which is a raw material so that the carbon content in the raw material alloy becomes less than that of Comparative Example 1. Accordingly, the amount of carbons which invaded into the main phase of the rare earth permanent magnet of Example 1 was less than that of Comparative Example. According to the element distribution result illustrated in FIG. 1A, the carbon content was an ultramicro amount in Example 1 and, therefore, it is surmised that regarding the carbons, for example, substitution with atoms other than the B atoms, such as the Fe atoms, preceded and no substitution by the C atoms occurred at most of the sites occupied by the B atoms.

FIG. 7 illustrates the element analysis result of the rare earth permanent magnet with the same composition as that of Example 4. Regarding the element analysis result of Example 4, the existence of an area where cycles of the Co atoms matched cycles of the Nd atoms was confirmed as in Example 1. As illustrated in FIG. 7, at least 27 cycles of the Co atoms matched at least 27 cycles of the Nd atoms and the distance of the C-axis direction of the relevant area was approximately 14 nm.

FIG. 8 and FIG. 9 are analysis results by the Rietveld method of Example 1 and Comparative Example 1. Equipment used and usage conditions are described below. Analysis software used is IETAN-FP.

Analysis Apparatus: horizontal X-ray diffractometer SmartLab by Rigaku Corporation Analysis Conditions:

Target: Cu

Monochromator: use symmetric Johansson-type Ge crystals (CuKα1) on incidence side Target Output: 45 kV-200 mA Detector: one-dimensional detector (HyPix3000)

(Normal Measurement): θ/2θ scan

Entrance Slit System: divergence ½°

Slit Light-Receiving System: 20 mm

Scan Speed: 1°/min

Sampling Width: 0.01°

Measuring Angle (2θ): 10° to 110°

FIG. 8 and FIG. 9 are diagrams for explaining crystal structure analysis of Examples of the present disclosure. As a result of the analysis, a lattice constant of Example 1 was successfully identified as indicated in FIG. 8A. FIG. 8B indicates ICSD and literature data to which reference was made. It was successfully identified based on the analysis result indicated in FIG. 8 that the crystals of the main phase of this embodiment belong to $P4_2/mnm$. Regarding also Comparative Example 1, a lattice constant and an identification method were analyzed by the Rietveld method and the same analysis results as those of Example 1 were obtained. Specifically speaking, the lattice constant and literature data to which reference was made in Comparative Example 1 were the same as those in FIG. 8A and FIG. 8B relating to Example 1.

Subsequently, fitting of an X-ray diffraction pattern of Example 1 with a model pattern was performed. The model pattern is a pattern obtained by combining calculation results of X-ray diffraction patterns of, for example, NdO crystals and arbitrary $Nd_2Fe_{14}B$ crystals. The arbitrary $Nd_2Fe_{14}B$ crystals mean crystals obtained by simulation to change an arbitrary crystal parameter of known $Nd_2Fe_{14}B$ crystals and cause atoms occupying an arbitrary one site existing in the space group to be substituted with the atoms of the element L (Co in Example 1). A fitting index is expressed as an s value and the analysis was conducted so that the s value would become a value close to 1. The s value is defined as $s=R_{wp}/R_e$. Fitting results of $R_{wp}=2.141$, $R_e=1.798$, $s=1.1907$ were obtained by means of simulation.

A plurality of model patterns were further analyzed in order to obtain a model whose s value would become smaller than the model pattern which obtained the above-described fitting result. As a result, FIG. 9 illustrates the analysis result of the model pattern with a further smaller s value. In a "Judgment" column of FIG. 9, "○" means that the atoms occupying the relevant site were substituted with the atoms of the element L (the Co atoms in FIG. 9) (an occupancy rate value of the Co atoms is more than 0 and 1 or less); "x" means that the atoms occupying the relevant site were not substituted with the atoms of the element L (the Co atoms in FIG. 9) (the occupancy rate value of the Co atoms is 0 or less); and "Δ" means that no judgment could not be made because the result lacked physical consistency (the occupancy rate value of the Co atoms is more than 1).

Referring to FIG. 9, the occupancy rates of the Co atoms at the respective sites are: 0.0349 at the 4f site occupied by the B atoms; 0.0252 at the second 4f site occupied by the Nd atoms; and 0.9211 at the first 8j site occupied by the Fe atoms. The occupancy rate of the Co atoms at each of the above-mentioned sites exceeded 0.

Specifically speaking, it means that the crystals of Example 1 are $Nd_2Fe_{14}B$ crystals belonging to $P4_2/mnm$ and the Co atoms exist at the 4f site occupied by the B atoms, the second 4f site occupied by the Nd atoms, and the first 8j site occupied by the Fe atoms, respectively. Accordingly, it was confirmed that some of the B atoms at the first 4f site, some of the Nd atoms at the second 4f site, and some of the Fe atoms at the first 8j site were substituted with the Co atoms. On the other hand, the relevant occupancy rate of the Co atoms was 0 or less or could not be judged at the 4g site occupied by the Nd atoms, the 4c site occupied by the Fe atoms, the first and second 16k sites occupied by the Fe atoms, the second 8j site occupied by the Fe atoms, and the 4e site occupied by the Fe atoms, so that it was surmised and recognized that the atoms existing at those sites were not substituted by the Co atoms.

The Rietveld analysis was also conducted for Comparative Example 1 by the same method as in Example 1. FIG. 10 illustrates the analysis results of Comparative Example 1 when the fitting results of $R_{wp}$=1.763, $R_e$=1.729, s=1.0195 were obtained. Referring to FIG. 10, the occupancy rates of the Co atoms at the respective sites are: 0.0166 at the 4f site occupied by the B atoms; 0.0233 at the second 4f site occupied by the Nd atoms; and 0.8405 at the first 8j site occupied by the Fe atoms. The occupancy rate of the Co atoms at each of the above-mentioned sites exceeded 0.

Specifically speaking, it means that the crystals of Comparative Example are $Nd_2Fe_{14}B$ crystals belonging to $P4_2/mnm$ and the Co atoms exists at the first 4f site occupied by the B atoms, the 4f site occupied by the Nd atoms, and the second 8j site occupied by the Fe atoms, respectively. Accordingly, it was confirmed in Comparative Example 1 that some of the B atoms at the first 4f site, some of Nd at the second 4f site, and some of Fe at the first 8j site were substituted with the Co atoms. However, when comparing the occupancy rates of the Co atoms at the 4f site occupied by the B atoms between Example 1 and Comparative Example 1, the occupancy rate of Example 1 is larger. As a result, it was confirmed that Example 1 in which the carbon content was reduced had a larger amount of the B atoms substituted by the Co atoms that that of Comparative Example 1.

Incidentally, regarding Comparative Example 1, the relevant occupancy rate of the Co atoms was 0 or less or could not be judged at the 4g site occupied by Nd, the 4c site occupied by Fe, the first and second 16k sites occupied by Fe, the second 8j site occupied by Fe, and the 4e site occupied by Fe, so that it was surmised and recognized that the atoms existing at the relevant sites were not substituted by the Co atoms.

Comparative Example 4-1 and Comparative Example 4-2

Comparative Example 4-1 and Comparative Example 4-2 were prepared. The raw material alloy with the same charged composition as that of Example 4 was used for Comparative Example 4-1 and Comparative Example 4-2. Regarding Comparative Example 4-1, the heat treatment step was not executed. However, Comparative Example 4-1 was prepared by executing all other steps including the degassing step and the drying step under the same conditions as those of Example 4. Regarding Comparative Example 4-2, the degassing step, the drying step, and the heat treatment step were not executed. However, Comparative Example 4-2 was prepared by executing all other steps excluding the above-mentioned steps under the same conditions as those of Example 4.

FIG. 11 is diagrams for explaining a manufacturing method of Comparative Examples of the present disclosure. FIG. 11A and FIG. 11B illustrate transitions of the degree of vacuum and the internal furnace temperature in the degreasing step and the sintering step of Comparative Example 4-1 and Comparative Example 4-2. When comparing FIG. 11A regarding Comparative Example 4-1 and FIG. 11B regarding Comparative Example 4-2, spike waveforms are observed in the sintering step in FIG. 11B where the degassing step and the drying step were not executed. On the other hand, regarding Example 4, the degassing step and the drying step were executed before the degreasing step, so that no spike waveform appeared in the sintering step (which is not illustrated in the drawing).

The rare earth permanent magnet according to this embodiment has a high magnetic moment and exhibits good magnetic performance. The rare earth permanent magnet contributes to downsizing, weight reduction, and cost reduction of electric motors, offshore wind power generators, industrial motors, and so on.

INDUSTRIAL APPLICABILITY

The rare earth permanent magnet which exhibits the high magnetic performance can be provided according to some embodiments of the present disclosure.

REFERENCE SIGNS LIST

100: crystal structure of unit lattice
101: R—Fe—B layer
102: Fe layer
200: first cycle of Co atoms
201: first inflection point in first cycle of Co atoms
202: second inflection point in first cycle of Co atoms
203: third inflection point in first cycle of Co atoms (first inflection point in second cycle of Co atoms)
210: second cycle of Co atoms
211: first inflection point in second cycle of Co atoms
212: second inflection point in second cycle of Co atoms
213: third inflection point in second cycle of Co atoms
300: first cycle of Nd atoms
301: first inflection point in first cycle of Nd atoms
302: second inflection point in first cycle of Nd atoms
303: third inflection point in first cycle of Nd atoms (first inflection point in second cycle of Nd atoms)
310: second cycle of Nd atoms
311: first inflection point in second cycle of Nd atoms
312: second inflection point in second cycle of Nd atoms
313: third inflection point in second cycle of Nd atoms

The invention claimed is:

1. A rare earth permanent magnet manufacturing method comprising:

a degreasing step of retaining, in vacuum, a green compact of a raw material alloy containing a rare earth element R of one or more types including Nd, B, Fe and an element of one or more types selected from the group consisting of Co, Be, Li, Al, Si, Cu, Nb, Zr, Ti, and Ga; and a carbon reduction step of reducing a carbon content in the green compact before the degreasing step, wherein the carbon reduction step includes a degassing step of retaining the green compact at a temperature of 100° C. or lower for one hour or longer, wherein a drying step is executed after the degassing step, and wherein the carbon reduction step includes the drying step of retaining the green compact in an atmosphere of a dew point of −60° C. or lower before the degreasing step.

2. The rare earth permanent magnet manufacturing method according to claim 1, further comprising:

a sintering step of sintering the green compact after the degreasing step; and a heat treatment step of applying a heat treatment to a sintered compact produced in the sintering step at a temperature lower than a sintering temperature.

* * * * *